US005765288A

United States Patent [19]

Hagler, Jr.

[11] Patent Number: 5,765,288

[45] Date of Patent: Jun. 16, 1998

[54] DUAL METHOD WALLCOVERING CREASER AND TRIMMER APPARATUS

[76] Inventor: Luther C. Hagler, Jr., 1701 N. Danville, Abilene, Tex. 79603

[21] Appl. No.: 685,990

[22] Filed: Jul. 22, 1996

[51] Int. Cl.[6] ..... B26B 3/08

[52] U.S. Cl. ..... 30/280; 30/294; 30/314

[58] Field of Search ..... 30/294, 293, 280, 30/314

[56] References Cited

U.S. PATENT DOCUMENTS

| | | | |
|---|---|---|---|
| 1,546,975 | 7/1925 | Feller | 30/294 |
| 1,599,129 | 9/1926 | Heighton | 30/294 |
| 2,537,287 | 1/1951 | Thomas | 30/294 |
| 2,593,601 | 4/1952 | Pollak | 30/294 |
| 2,810,194 | 10/1957 | Unsinger | 30/294 |
| 3,230,620 | 1/1966 | Embleton | 30/314 |
| 3,380,159 | 4/1968 | Winston | 30/294 |
| 3,422,533 | 1/1969 | Keller | 30/314 |
| 3,728,791 | 4/1973 | Holmquist | 30/294 |
| 4,134,206 | 1/1979 | Beermann | 30/294 |
| 4,813,134 | 3/1989 | Buffin | 30/294 |

FOREIGN PATENT DOCUMENTS

| | | | |
|---|---|---|---|
| 566233 | 12/1944 | United Kingdom | 30/294 |
| 736341 | 9/1955 | United Kingdom | 30/294 |

*Primary Examiner*—Kenneth E. Peterson
*Assistant Examiner*—Sean A. Pryor

[57] ABSTRACT

A new and improved wallcovering creaser and trimmer with a tool portion having a rounded periphery. A threaded projection and a pair of projections are secured to the tool portion. A handle projection is integral with the rounded periphery. A radially extending aperture is formed through the rounded periphery of the tool portion. A blade portion has a first sharp edge, a second sharp edge, a central aperture and two oblong apertures formed through the center of the blade portion. The blade portion is secured on the tool portion. The first sharp edge is positioned within the radially extending aperture of the tool portion. The second sharp edge is positioned with one end extending outwardly of the rounded periphery of the tool portion.

1 Claim, 3 Drawing Sheets

DUAL METHOD WALLCOVERING CREASER AND TRIMMER APPARATUS

BACKGROUND OF THE INVENTION

1. Field of the Invention

The present invention relates to a wallcovering creaser and trimmer and more particularly pertains to a convenient method of both creasing and trimming various types of wallcoverings and also cutting wallcovering on a work table with a wallcovering creaser and trimmer.

2. Description of the Prior Art

The use of wallpaper trimmers is known in the prior art. More specifically, wallpaper trimmers heretofore devised and utilized for the purpose of cutting wallpaper are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,181,320 to Tucciarone discloses a wallpaper trimming tool and its methods of use.

U.S. Pat. No. 5,050,306 to Renaud discloses a wallpaper border marker/cutter device for trimming wallpaper at a preselected level below a ceiling.

U.S. Pat. No. 4,041,605 to Selfridge discloses a wallpaper trimmer which facilitates accurate and precise cutting of wallpaper along a joint between a wall being papered and an adjacent structural member.

U.S. Pat. No. 3,924,328 to Mould discloses a cutting tool for wallpaper including a pair of wheels.

U.S. Pat. No. 3,837,976 to Weppner discloses a wallpaper trimmer having a wallpaper slot and a blade holder.

In this respect, the wallcovering creaser and trimmer according to the present invention substantially departs from the conventional concepts and designs of the prior art, and in so doing provides an apparatus primarily developed for the purpose of a convenient method of both creasing and trimming various types of wallcoverings and also cutting wallcovering on a work table with a wallcovering creaser and trimmer.

Therefore, it can be appreciated that there exists a continuing need for a new and improved wallcovering creaser and trimmer which can be used for a convenient method of both creasing and trimming various types of wallcoverings and also cutting wallcovering on a work table with a wallcovering creaser and trimmer. In this regard, the present invention substantially fulfills this need.

SUMMARY OF THE INVENTION

In view of the foregoing disadvantages inherent in the known types of wallpaper trimmers now present in the prior art, the present invention provides an improved wallcovering creaser and trimmer. As such, the general purpose of the present invention, which will be described subsequently in greater detail, is to provide a new and improved wallcovering creaser and trimmer which has all the advantages of the prior art and none of the disadvantages.

To attain this, the present invention essentially comprises a tool portion having a rounded periphery, an upper surface, and a lower surface. The rounded periphery has a smooth creasing surface. A threaded projection is secured to the tool portion. A pair of projections are secured to the upper surface. The pair of projections are situated on opposite sides of the threaded projection at equidistant lengths therefrom. A handle projection is integral with the rounded periphery. The handle projection extends upwardly from the tool portion. The handle projection has an upper surface and a lower surface. Two apertures are formed through the handle projection. An upper handle having two apertures therethrough is positioned on the upper surface of the handle projection. The two apertures of the handle projection are in alignment with the two apertures of the upper handle. A lower handle having two apertures therethrough is positioned on the lower surface of the handle projection. The two apertures of the handle projection are in alignment with the two apertures of the lower handle. A pair of handle rivets are positioned within the aligning apertures of the upper handle, the handle projection, and the lower handle thus securing thereto. A radially extending aperture is formed through the rounded periphery of the tool portion. The device contains a blade portion having a first sharp edge, a second sharp edge, two side edges, and a planar intermediate surface therebetween. A central aperture is formed through the center of the intermediate surface. Two oblong apertures are formed through the intermediate surface. The two oblong apertures are situated on opposite sides of the central aperture. The blade portion is positioned on the tool portion with the central aperture in alignment with the threaded projection of the tool portion and the oblong apertures in alignment with the pair of projections of the tool portion. The first sharp edge has a first end and a second end. The first sharp edge is positioned within the radially extending aperture of the tool portion inward of the first end and serves to provide a cutting edge for wallpaper. The second sharp edge has a first end and a second end. The second sharp edge is positioned with the second end extending outwardly of the rounded periphery of the tool portion that serves to provide an additional edge for cutting wallpaper. A removable coupling means is secured to the threaded projection of tool portion serving to secure the blade portion to the tool portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wallcovering creaser and trimmer which has all the advantages of the prior art wallpaper trimmers and none of the disadvantages.

It is another object of the present invention to provide a new and improved wallcovering creaser and trimmer which may be easily and efficiently manufactured and marketed.

It is a further object of the present invention to provide a new and improved wallcovering creaser and trimmer which is of a durable and reliable construction.

An even further object of the present invention is to provide a new and improved wallcovering creaser and trimmer which is susceptible of a low cost of manufacture with regard to both materials and labor, and which accordingly is then susceptible of low prices of sale to the consuming public, thereby making such wallcovering creaser and trimmer economically available to the buying public.

Still yet another object of the present invention is to provide a new and improved wallcovering creaser and trimmer which provides in the apparatuses and methods of the prior art some of the advantages thereof, while simultaneously overcoming some of the disadvantages normally associated therewith.

Still another object of the present invention is to a convenient method of both creasing and trimming various types of wallcoverings and also cutting wallcovering on a work table with a wallcovering creaser and trimmer.

Lastly, it is an object of the present invention to provide a new and improved wallcovering creaser and trimmer with a tool portion having a rounded periphery. A threaded projection and a pair of projections are secured to the tool portion. A handle projection is integral with the rounded periphery. A radially extending aperture is formed through the rounded periphery of the tool portion. A blade portion has a first sharp edge, a second sharp edge, a central aperture and two oblong apertures formed through the center thereof. The blade portion is secured on the tool portion. The first sharp edge is positioned within the radially extending aperture of the tool portion. The second sharp edge is positioned with one end extending outwardly of the rounded periphery of the tool portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
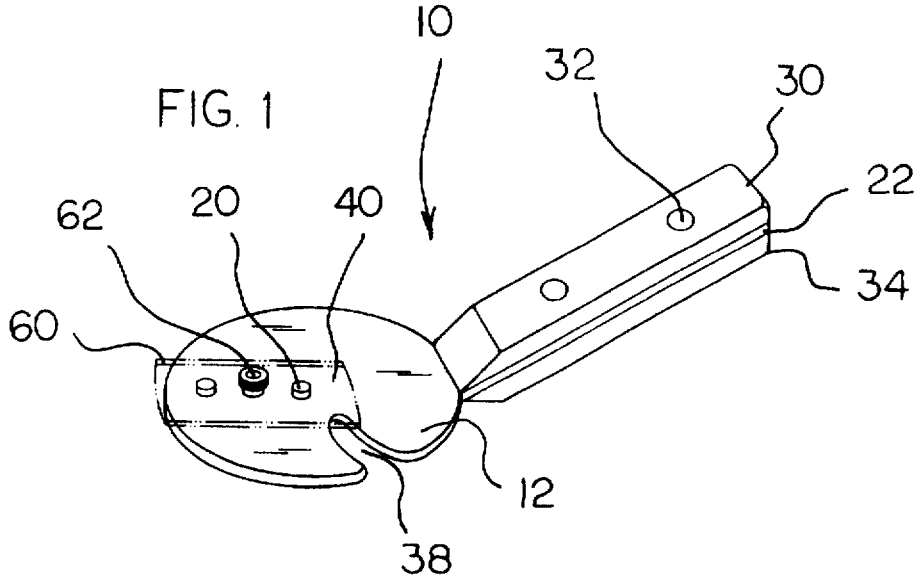
FIG. 1 is a perspective view of the preferred embodiment of the wallcovering creaser and trimmer constructed in accordance with the principles of the present invention.
Figure 2:
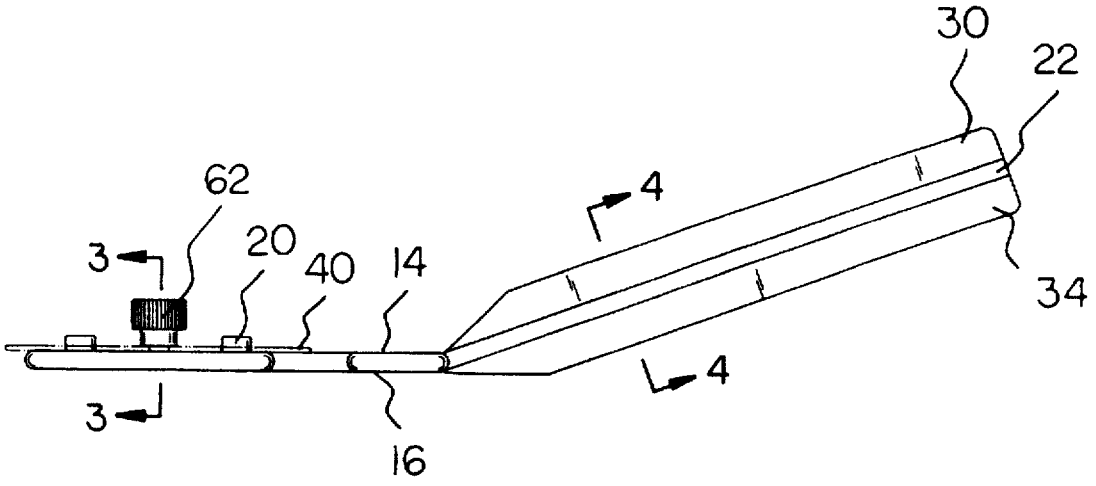
FIG. 2 is a side view of the present invention disclosing the smooth creasing surface.
Figure 3:
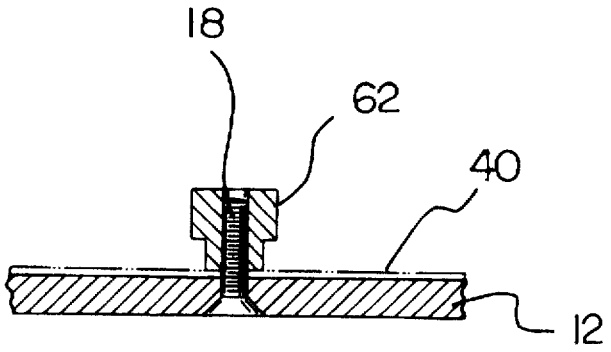
FIG. 3 is a cross-sectional view of the present invention as seen along line 3—3 of FIG. 2.

With reference now to the drawings, and in particular, to FIG. 1 thereof, the preferred embodiment of the new and improved wallcovering creaser and trimmer embodying the principles and concepts of the present invention and generally designated by the reference number 10 will be described.

Specifically, it will be noted in the various Figures that the device relates to a new and improved wallcovering creaser and trimmer for creasing and trimming various types of wallcoverings and also cutting wallcovering on a work table. In its broadest context, the device consists of a tool portion, a pair of handle rivets, a radially extending aperture, a blade portion, and a removable coupling means.

The device 10 contains a tool portion 12 having a rounded periphery, an upper surface 14, and a lower surface 16. The rounded periphery has a smooth creasing surface. The smooth creasing surface is placed against the wallcovering at places that need to be trimmed, such as ceilings, corners, door frames, or anywhere else trimming is needed. A threaded projection 18 is secured to the tool portion 12 at a point approximately midway between the center of the tool portion and the periphery. A pair of projections 20 are secured to the upper surface 14. The pair of projections 20 are situated on opposite sides of the threaded projection 18 at equidistant lengths therefrom. A handle projection 22 is integral with the rounded periphery. The handle projection 22 extends upwardly from the periphery of the tool portion 12 at an angle of approximately 30 degrees (not shown) thus creating a bend in the handle projection 22 that keeps the tool portion 12 in the proper position. The handle is formed on the periphery of the tool portion in linear alignment with a line containing the threaded protrusion and the center of the tool portion. The handle projection 22 has an upper surface 24 and a lower surface 26. Two apertures 28 are formed through the handle projection 22. An upper handle 30 having two apertures 32 therethrough is positioned on the upper surface 24 of the handle projection 22. The two apertures 28 of the handle projection 22 are in alignment with the two apertures 32 of the upper handle 30. A lower handle 34 having two apertures 36 therethrough is positioned on the lower surface 26 of the handle projection 22. The two apertures 28 of the handle projection 22 are in alignment with the two apertures 36 of the lower handle 34.

Figure 4:
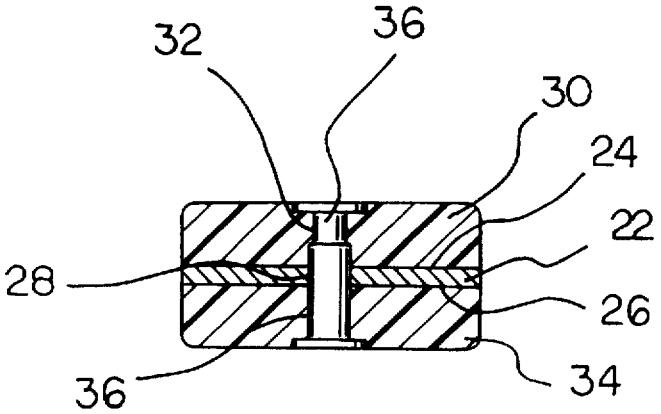
FIG. 4 is a cross-sectional view of the present invention as seen along line 4—4 of FIG. 2.

As shown in FIG. 4, a pair of handle rivets 36 are positioned within the aligning apertures of the upper handle, the handle projection, and the lower handle thus securing thereto.

Figure 5:
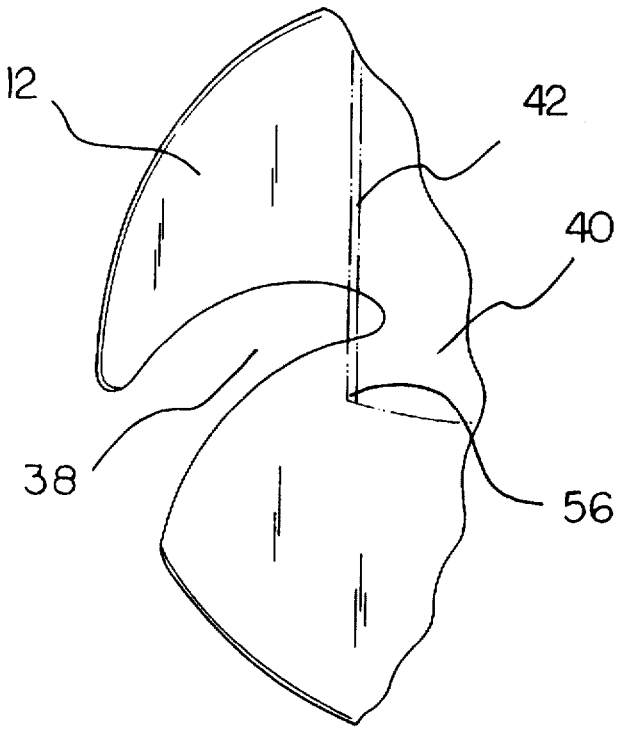
FIG. 5 is an enlarged view of the cutting groove of the present invention.

As shown in FIG. 5, a radially extending aperture 38 is formed through the rounded periphery of the tool portion 12. The aperture 38 is used to receive wallcovering in preparation of being cut. Ideally, the aperture is in approximate linear alignment with a line perpendicular to the line (not shown) containing the threaded protrusion and center of the tool portion. Also, the aperture also has a slightly arcuate configuration with a first end proximate the center of the tool portion and a second end curving slightly below the aforementioned perpendicular line. The aperture is thus tailored for optimal cutting of wallpaper on a bench, floor, or the like.

The device 10 contains a blade portion 40 having a first sharp edge 42, a second sharp edge 44, two side edges 46, and a planar intermediate surface 50 therebetween. A central aperture 52 is formed through the center of the intermediate surface 50. Two oblong apertures 54 are formed through the intermediate surface 50. The two oblong apertures 54 are situated on opposite sides of the central aperture 52. The blade portion 40 is positioned on the tool portion 12 with the central aperture 50 in alignment with the threaded projection 18 of the tool portion 12 and the oblong apertures 54 in alignment with the pair of projections 20 of the tool portion 12. The projections 20 serve to help hold the blade portion 40 in the correct position at all times. The first sharp edge 42 has a first end 56 and a second end 58. The first sharp edge 42 is positioned within the radially extending aperture 38 of the tool portion 12 inward of the first end 56 and serves to provide a cutting edge for wallpaper. The second end 58 extends outwardly from the rounded periphery of the tool portion. The second sharp edge 44 has a first end 59 and a second end 60. The second sharp edge 44 is positioned with the second end 60 extending outwardly of the rounded periphery of the tool portion 12 that serves to provide an additional edge for cutting wallpaper. The present invention may thus be employed by either a right or left hand user. The sharp second edge 44 trims wallcovering neatly in the crease.

Figure 6:
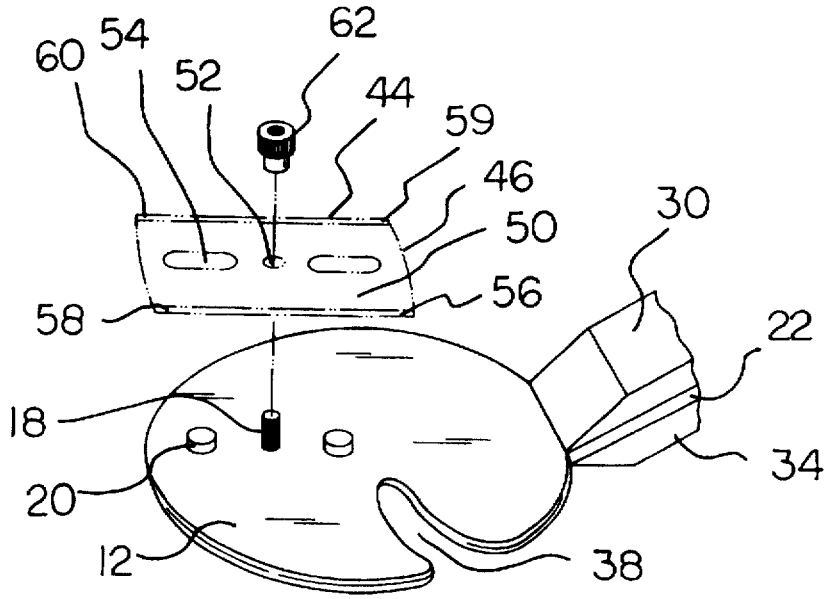
FIG. 6 is an exploded view of the present invention showing the razor blade and the fastening means.

A removable coupling means 62 is secured to the threaded projection 18 of tool portion 12 serving to secure the blade portion 40 to the tool portion 12. The preferred coupling means 62 employed in the device is a thumb screw as shown in FIG. 6.

The advantages over methods used now are very significant. The normal method is using a broad knife or trowel as a guide for the conventional razor knife, trimming a small portion then moving the broad knife or trowel and trimming again. The present invention allows one continuous motion along cuts and greatly increases productivity. It is also excellent for tight areas where it is difficult to get two hands to hold the broad knife and razor knife, where the present invention requires only one hand and is smaller than the currently used tools.

The method associated with the present invention as provided hereinabove includes placing the rounded periphery of the tool against the wallcovering. The tool is then slid along the wallpaper in a first direction while pulling excess slack out of the wallpaper thereby effecting a sharp crease. The next step is to rotate the circular tool portion via the handle slightly so as to engage the second end of the first sharp edge with the wallpaper coincident with the crease. The tool may then be conveniently slid along the wallpaper in a second direction opposite the first direction thereby affording a straight cut. For affording a dual method of cutting wallpaper, the radially extending aperture is provided which utilizes the single razor blade of the present invention. A loose portion of wallpaper may be inserted within the aperture. After that, the tool may be slid along the wallpaper to thereby afford a straight cut.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A wallcovering creaser and trimmer for creasing and trimming various types of wallcoverings and also cutting wallcovering on a work table comprising, in combination:

a circular tool portion having a rounded periphery, an upper surface, and a lower surface, the rounded periphery having a smooth creasing surface, a threaded projection secured to the circular tool portion at a point approximately half way between a center of the top portion and the periphery thereof, a pair of projections secured to the upper surface, the pair of projections on opposite sides of the threaded projection at equidistant lengths therefrom, a handle projection integral with the rounded periphery, the handle projection extending upwardly from the circular tool portion at an angle of approximately 30 degrees thus creating a bend, the handle projection formed in a first plane which is oblique from a second plane in which the tool portion resides, the handle projection having an upper surface and a lower surface, two apertures formed through the handle projection, an upper handle having two apertures therethrough positioned on the upper surface of the handle projection, the two apertures of the handle projection in alignment with the two apertures of the upper handle, the upper handle having a downwardly sloped proximal end, a lower handle having two apertures therethrough positioned on the lower surface of the handle projection, the two apertures of the handle projection in alignment with the two apertures of the lower handle, the lower handle having a downwardly sloping proximal end to prevent the lower handle from impeding a user from creasing wallpaper;

a pair of handle rivets positioned within aligning apertures of the upper handle, the handle projection, and the lower handle thus securing the upper handle and the lower handle to the handle projection;

a radially extending aperture formed through the rounded periphery of the circular tool portion for receiving wallcovering in preparation of being cut, the radially extending aperture being about ninety degrees from the handle projection thereby residing in linear alignment with a second line perpendicular to a first line containing the threaded protrusion and the center of the tool portion, the radially extending aperture having a first end proximate the center of the tool portion and a second end curving slightly below the second line, wherein the aperture has an arcuate configuration;

a blade portion having a first sharp edge, a second sharp edge, two side edges, and a planar intermediate surface therebetween, a central aperture formed through the center of the intermediate surface, two oblong apertures formed through the intermediate surface, the two oblong apertures situated on opposite sides of the central aperture, the blade portion positioned on the circular tool portion with the central aperture aligning with the threaded projection of the circular tool portion and the oblong apertures aligning with the pair of projections of the tool portion, the first sharp edge having a first end and a second end, the first end of the first sharp edge positionable above the radially extending aperture of the circular tool portion inward of the first end thereof serving to provide a cutting edge for wallpaper, said cutting edge and tool portion lie in said second plane, the second end of the first sharp edge extending from the rounded periphery for providing an edge for cutting wall paper, the second sharp edge having a first end and a second end, the second sharp edge positioned with the second end thereof extending outwardly of the rounded periphery of the circular tool portion serving to provide an additional edge for cutting wallpaper; and a removable coupling means secured to the threaded projection of tool portion serving to secure the blade portion to the circular tool portion, the removable coupling means comprising a thumb screw.

* * * * *